United States Patent [19]

Harper, Jr.

[11] Patent Number: 4,790,460

[45] Date of Patent: Dec. 13, 1988

[54] SKATEBOARD CARRIER

[75] Inventor: Arthur L. Harper, Jr., Houston, Tex.

[73] Assignee: Recreation Products of Texas, Inc., Houston, Tex.

[21] Appl. No.: 83,178

[22] Filed: Aug. 10, 1987

[51] Int. Cl.[4] ..... A45F 3/04

[52] U.S. Cl. ..... 224/209; 224/210; 224/259; 224/261; 224/250; 224/907

[58] Field of Search ..... 224/209–216, 224/257–263, 250, 907

[56] References Cited

U.S. PATENT DOCUMENTS

| | | | |
|---|---|---|---|
| 995,458 | 6/1911 | Harriman | 224/214 |
| 1,209,271 | 12/1916 | Skancke et al. | 224/214 X |
| 1,296,619 | 3/1919 | Bulat | 224/907 X |
| 1,714,819 | 5/1929 | Rhodes | 224/250 X |
| 1,816,510 | 7/1931 | Anderson | 224/250 X |
| 2,841,317 | 7/1958 | Elden | 224/907 X |
| 3,401,857 | 9/1968 | Wilson et al. | 224/214 |
| 3,610,490 | 10/1971 | Smith | 224/214 X |
| 4,308,982 | 1/1982 | Hall | 224/250 X |
| 4,310,110 | 1/1982 | Dexter | 224/250 X |
| 4,337,883 | 7/1982 | Pate | 224/253 X |
| 4,420,103 | 12/1983 | Douglass | 224/907 X |
| 4,693,402 | 9/1987 | Comeau | 224/907 X |

*Primary Examiner*—Henry J. Recla
*Attorney, Agent, or Firm*—Tim L. Burgess

[57] ABSTRACT

A carrier for transport of a skateboard which leaves use of the hands free, includes a flexible resiliently deformable pad body with front and back faces configured to cover substantially the upper back of the bearer. The lateral sides of the pad body have pairs of attachment members to which cinching straps removably attach across the back face to cinchingly loop around the axle support brackets of a skateboard vertically oriented and positioned with its topside against the back face of the pad body and its wheels extending outwardly. The lateral edges of the pad body at the attachment member and the attachment members are drawn tightly against the lateral margins to restrain lateral movement of the skateboard, verticle movement of which is restrained by the loops about the axle support brackets. A plurality of lateral attachment member pairs permits vertical adjustment of the board on the pad body and supplementarily provides for attachment of skateboarding accessory articles. Compact articles may be accommodated in a back face pocket.

5 Claims, 1 Drawing Sheet

SKATEBOARD CARRIER

BACKGROUND OF THE INVENTION

This invention relates to a carrier for safe transport of skateboards and skateboard accessories without use of the hands.

Skateboarding is a popular sport, particularly among young people. A problem associated with the sport is that, unless a skateboard user transports himself on the skateboard to a destination where he intends to do skateboarding as sport, then, while he is getting there, the skateboard has to be carried by hand. Typically a skateboard may be 24 to 36 inches long, 6 to 10½ inches wide and weight 7 to 8 pounds. It is cumbersome and heavy to carry. Not suprisingly a skateboarder may not chose to walk and hand carry the board to his destination, but instead may try to carry the board in one hand and bicycle or motorbike himself there, unsafely risking control of the bicycle or motorbike to his one free hand. Moreover, many skateboarders need to transport skateboarding accessory gear such as knee pads, elbow pads, gloves, helmet, adjusting tools, and the like. In addition, some take their skateboards to school for after school sport skateboarding, and a need to carry schoolbooks and other schooling materials and articles can further compound the problem of skateboard transport, increasing the risk of unsafe transport if the skateboarder means to get there by bicycle or motorbike.

Another problem is that sometimes the skateboarder transports himself by skateboard to a destination, then has to carry the skateboard until he is ready to leave again. U.S. Pat. No. 4,337,883 to Pate for a skateboard holster attempted to address this problem of freeing the skateboarder's hands between use of the skateboard as transportation, but Pate's solution permits the skateboard to hand pendulously where it can swing and slap the leg of the user, slip up and down in the holster, and interfere with pedaling a bicycle.

SUMMARY OF THE INVENTION

A need exists, therefore, for a skateboard carrier by which a skateboarder may transport his skateboard yet have free use of his hands, including for such purposes as safe operation of a bicycle or motorbike.

It is a principle object of the present invention to provide a skateboard carrier which meets the foregoing need.

It is a related object of the present invention to provide a skateboard carrier which satisfies the principle object without interfering with normal pedaling operation of a bicycle or positioning the skateboard over the side or alongside a motorbike to the jeopardy of safe operation of the vehicle.

It is another object of the present invention to provide a skateboard carrier which meets the foregoing needs in such a way as to be useful for nonvehicular transport as well, and in this connection, to prevent or minimize skateboard slap or pound during rhythmic movement of the skateboarder, either while walking or when pedaling a bicycle.

It is another object of the present invention to provide a skateboard carrier which, while accomplishing the foregoing objectives also provides security of mount of the skateboard from vertical or lateral dislocation, at the same time maximizing skateboarder fit, comfort, and convenience when transporting the board.

It is yet another object of the present invention to maximize the utility of the carrier for transport of skateboards by providing for correlative transport of skateboard accessory articles and articles such as schoolbooks and the like.

Toward the accomplishment of these objects and advantages, the present invention, briefly summarized, comprises a skateboard carrier including a flexible, resiliently deformable pad body having front and back faces and shoulder strap means affixed to the front face by which the pad body may be worn on the back of the skateboard bearer. A plurality of flexible inelastic securing means in upper and lower portions of the pad body interconnect the lateral sides of the pad body across the back face of the pad body for releasably securing onto said back face, restrained from vertical and lateral movement, a skateboard vertically oriented with its topside against such back face and its wheels extending outwardly from the back face. The said securing means include pairs of flexible inelastic attachment members and pairs of flexible inelastic securing straps for attachment to the attachment members. Preferably cinch means secure the skateboard, cinching straps preferably being adapted to be removably positioned across the underside of the skateboard in a loop of which a forward run lies in front of, and a rear run lies behind, the axle support bracket for the outwardly extending skateboard wheels. The pad body of the skateboard carrier preferably includes a storage pocket which is accessible by closable and reopenable closure means such as zipper means in the back face of the pad body. In another embodiment the skateboard carrier further comprises at least one attachment member intermediate the uppermost and lowermost members for attaching by securing means such skateboard accessory articles such as knee pads and elbow pads securable thereby.

BRIEF DESCRIPTION OF THE DRAWINGS

The foregoing and other features and benefits of the present invention as well as a more complete understanding thereof will be more apparent from a study of the following detailed description of the invention in connection with the accompanying drawings, in which.

DETAILED DESCRIPTION OF THE PREFERRED EMBODIMENT

Figure 1:
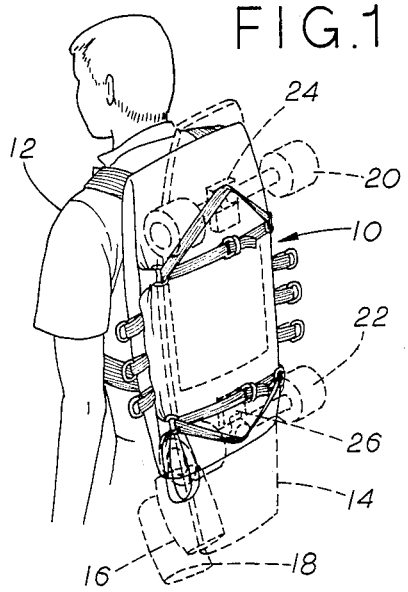
FIG. 1 shows a perspective of the skateboard carrier of this invention viewed from a rear oblique angle, also depicting in outline a carried skateboard and the skateboard accessory articles.

Referring to the drawing and more particularly to FIG. 1, a skateboard carrier, indicated generally by reference numeral 10, is shown mounted on the back of a bearer 12, transporting a skateboard 14 and skateboard accessory articles to include knee pads and elbow pads 16, 18. Skateboard 10 is vertically oriented and positioned with its topside toward bearer 12 so that the wheels 20, 22 thereof extend outwardly away from the bearer. Wheels 20, 22 are supported on axles carried by axle support brackets 24, 26, depicted in outline in FIGS. 1 and FIG. 3. In the vertical orientation illustrated, and as preferably mounted, the fore end of the skateboard is uppermost and the aft end of the skateboard is lowermost. This mounting is preferred because in a currently popular configuration for skateboards, the aft end is tilted upwardly from the horizontal plane of the board body, and if instead the upturned aft end is oriented uppermost with the topside of the board toward the bearer, the aft end can curve into the neck or head of the bearer. In the preferred orientation and the placement as hereinafter described, the upturned aft end curves inwardly about where the buttocks taper into the legs, so there is no interfering contact.

Referring to FIGS. 2–5, a pad body 30 is shown of generally rectangular peripheral configuration. The pad body has a vertical length and width of sufficient size to overlay substantially at least the upper (thoracic) back portion of the wearer. Suitably the length may be, for example, 20–21 inches and the width about 12 inches. The pad body 30 includes front panel 32 and back panel 34, preferably constructed of a flexible, durable fabric, suitably the tenting or awning fabric identified by the trademark CALLIOPE (TM), marketed by the Astrup Company, 2937 West 25th Stree, Cleveland, Ohio, 44113. This is a two-ply 100% polyester plainweave, coated with cleanable pigmented resin, of a 12.5 oz./yd. weight and 500 lbs×391 lbs tensile strength. Panels 32, 34 have opposed upper and lower end edges 36, 38 and opposed side edges 40, 42 connecting end edges 36, 38, with vertical rows of stitching 44, 45 fastening opposed side edges 40, 42 and horizontal rows of stitching 48, 49 fastening opposed end edges 36, 38. A cavity 50 is defined between stitched end edges 36, 38 and side edges 40, 42 of panels 32, 34.

Back panel 34 contains an aperture 52 which is spanned by zipper means 54 to include zipper support 56 and zipper 58 carried by support 56, which is sewn to the margin of aperture 52 by stitching 60. A fabric wall 62, shaped and sized to substantially conform to a major portion of back panel 34, is in faced opposition to the reverse side of back panel 34, to which it is secured at its periphery by stitching 64, thereby defining a storage pocket 66, of which closure and to which access is gained by zipper means 54.

A resiliently deformable support pad 68, preferably a thickened latex foam rubber pad, is contained within cavity 50. Use of such a pad not only cushions the wearer's back against the hard surfaces of the skateboard, but also permits the pad body to be laundered in a washing machine and spun dry. A suitable thickened latex pad is marketed by the name POLYFOAM, available as Stock No. E-55 from Sterling Manufacturing Company, 1203 White, Houston, Tex., 77007. Foam support pad 68 is sized to occupy the width and length of cavity 50 to support the front and back panels 32, 34 and separate the opposed end edges 36, 38 and side edges 40, 42 in full extension one from another.

A pair of shoulder straps 71–72 and 73–74 is affixed to front panel 32. The place of uppermost fixation 76 of the straps 71, 73 is spaced from end edge 36 of panel 32 such that a portion of the pad body 30 projects or rises above place of fixation 76, thereby providing, when pad body 30 is mounted by shoulder straps 72, 74 on bearer 12, a pad body rise between the skateboard and the neck and upper back of bearer 12 to guard and cushion against skateboard cervical contact. In the example given where the length of the pad body is 20–21 inches, the place of fixation 76 suitably may be three inches from end edge 3. Straps 71–72 and 73–74 are adjustable to size and comfort by cinching D-ring pairs 78 secured within a loop at the terminus of straps 72, 74. Suitably the strap adjustment means for straps 71–72, 73–74 instead may be a molded side release buckle, such as the side release buckle available from I T W Nexus Division of Illinois Tool Works, Inc., 201 Scott Street, Elkgrove Village, Ill. 60007, with the male end attached to one of the cooperating strap ends and the female to the other.

A mounting sheet 70 within cavity 50 is attached by vertical stitching 44, 45 and horizontal stitching 48, 49 to the side and end edges 40, 42 and 36, 38 of front and back panels 32, 34. Mounting sheet 71 fixedly mounts and secures foam support pad 68 at the side of sheet 71 which faces the reverse side of back panel 34. Mounting fixation preferably is by adhesive, suitably a spray adhesive such as FASTTACK (TM), Dayton Manufacturing Company, distributed by W. W. Grainger, Inc., 4545 Darien, Houston, Tex., 77028. The mounting sheet secures the foam pad from slippage within the confines of cavity 50, and is optional depending upon the relative stiffness of foam support pad 68.

Figure 2:
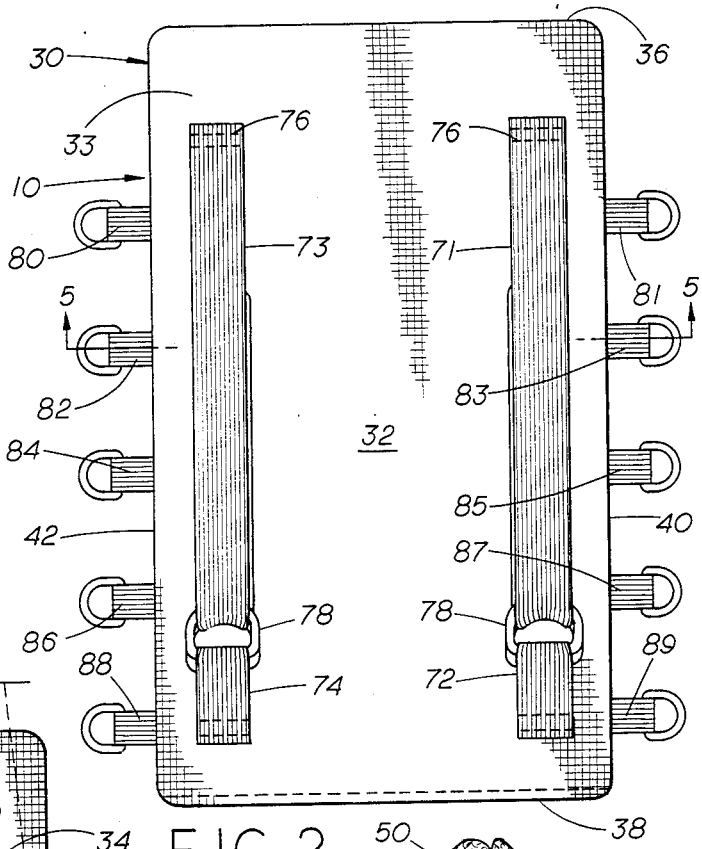
FIG. 2 is a front plan view of the skate board carrier.

A plurality of flexible inelastic securing strap attachment member pairs 80–81, 82–83, 84–85, 86–87, and 88–89 are affixed to body 30 by vertical stitching 44, 45 to opposite end edges 40, 42 of front and back panel members 32, 34. A first pair 80–81 is affixed at a location near the upper end edge 36 of body 30. A second pair 88–89 is affixed at a location near the lower end edge 38 of body 30. Suitably in the dimension example heretofore stated, this location may be centered about two inches from end edge 38. As best seen by FIG. 2, pair members 80–81 are affixed to opposed side edges 40, 42 of body 30 at a location more remote from end 36 than fixation place 76 for the upper shoulder straps 71, 73. Suitably in the dimension example heretofore stated, this location may be centered between four to five inches from end edge 36. A D-ring is affixed to the free end of each member of attachment member pairs 80–81, 82–83, 84–85, 86–87, and 88–89.

A plurality of flexible inelastic securing straps 90, 92 attach respectively to uppermost securing strap attachment members 80–81 and lowermost securing strap attachment members 88–89. In the embodiment illustrated, the securing straps 90 comprise a cinch strap passing and attaching through the D-rings of attachment members 80–81, with the cinch strap being cinchable at cinch ring buckles 91. Similarly, securing strap 92 is a cinch strap passing through the D-rings of lowermost attachment members 88–89 and is cinchable at cinch buckle 93. With skateboard 14 vertically oriented, fore-end up, as already described, cinching strap 90 is adapted to be removably positioned across the underside of skateboard 14 in a loop of which a forward run **90*a* lies in front of a leading edge 25 of axle support bracket 24 for skateboard front wheels 20. A rear run 90*b* lies behind the trailing edge 26 of axle support bracket 24. Similarly, lowermost cinching strap 92 is adapted to be removably positioned across the underside of the skateboard in a loop of which the forward run 92*a* lies in front of the leading edge 27 and the rear run lies behind the trailing edge 29 of the axle support bracket 28 for the skateboard rear wheels. By means of the cinch strap loop fore and aft of the front and rear edges of the axle support bracket for the front and rear wheels, weight of the skateboard is supported by attachment member pairs 80–81 and cinch strap 90 at loop rear run 90***b* and by attachment member pairs 88–89 and cinch strap 92 at loop rear run 92*b*, each bearing against the aft or trailing edges of the respective front and rear brackets for the front and rear skateboard wheels. Vertical movement of the skateboard is restrained both by attachment members 80–81 and the forward run 90*a* of the cinch strap bearing against the fore or leading portions of the front support bracket for the front wheels, and by attachment members 88–89 and the forward run of cinch strap 92*a* bearing against the leading edge of bracket 28 for the rear wheels.

Flexible but inelastic material, suitably woven nylon or polyester webbing, is required for the attaching members such as 80–81 and 88–89, and for the cinching straps 90, 92, in order to firmly restrain the skateboard against reciprocating or periodic motion and to fix the skateboard at a height position desired on the back of the bearer. An elastic material if employed for members 80–81, 88–89, or straps 90–92 unsuitably tends to yield or sag under the weight of the skateboard, and upon impartation to it of up and down forces from rhythmic or cyclic movement of the bearer, as during locomotion gait or where bicycle pedaling, the elastic material unsuitably tends to yield and rebound in a reciprocating motion of its own, to the discomfort of the bearer.

Figure 3:
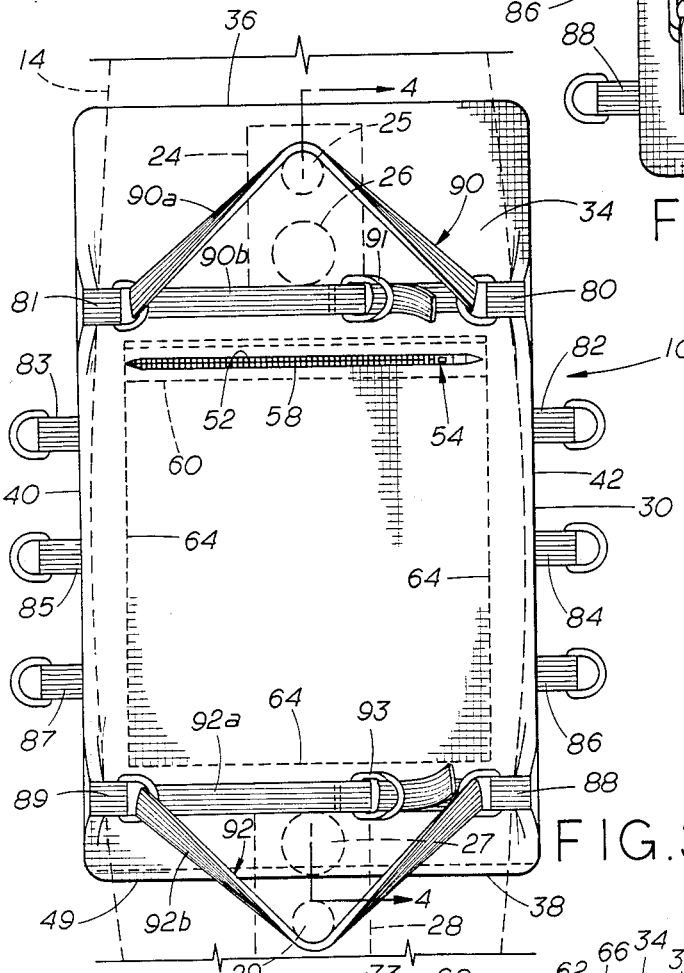
FIG. 3 is a rear plan view of the skate board carrier, also showing in outline an intermediate portion of the skateboard, including the axle support brackets for the skateboard wheels.
Figure 4:
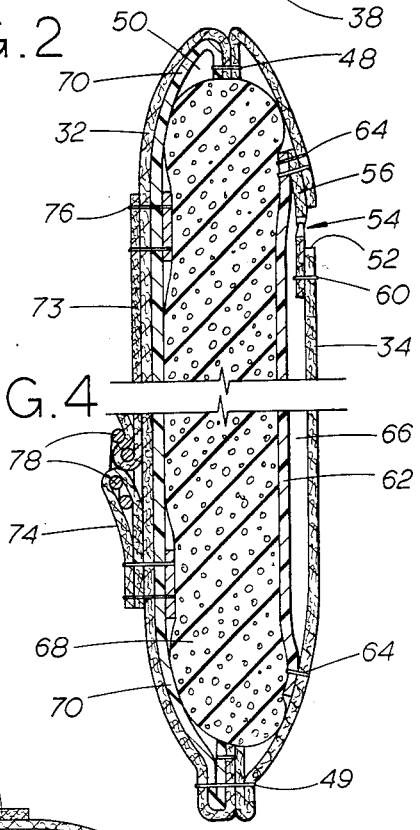
FIG. 4 is a longitudinal sectional view along the lines 4—4 of FIG. 3.
Figure 5:
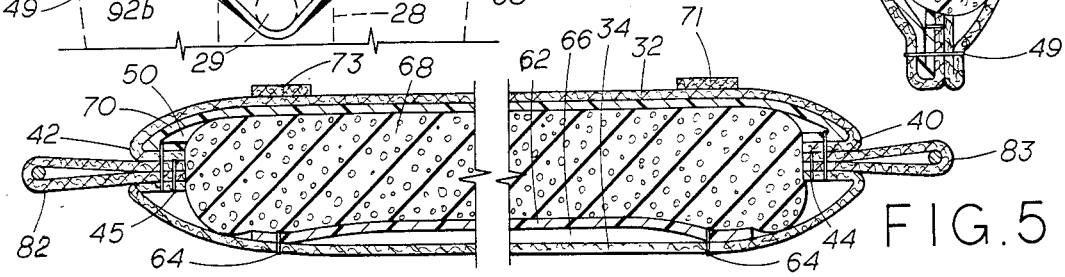
FIG. 5 is a cross-sectional view along the lines 5—5 of FIG. 2.

Lateral slippage of the mounted skateboard is restrained in the present invention by the combination of a resilient deformable pad body 30 provided by the foam support pad 68 and the flexible fabric panels 32,34 in functional cooperation with the flexible inelastic attachment members 80–81, 88–89, and flexible inelastic cinching straps 90–92. As illustrated in FIGS. 1 and 3, with the skateboard mounted and cinched within loops 90*a*–90*b* and 92*a*–92*b* to restrain vertical skateboard movement, both the side edges 40,42 of back panel 34 at the places of attachment of members 80–81 and 88–89 and the members 80–81 and 88–89 are snugged into securing lateral wrap engagement with the lateral margins and undersurface of skateboard 14, thereby to restrain lateral movement of the skateboard.

In operation, the skateboard 14 is positioned on the backpanel 34 as illustrated in FIG. 1. Cinch strap 90 is passed through the D-rings of upper pairs of attachment members 80–81 or 82–83 and cinch strap 92 is passed through the D-rings of lower pairs of attachment members 86–87 or 88–89, according to the height placement on the carrier desired by the bearer. The unbuckled end of straps 90, 92 are respectively looped around the fore and aft aspects of the axle support brackets 24, 28 and then respectively behind the aft and in front of the fore aspects of brackets 24, 28, thence passed into the cinch buckles 91, 93 and cinched tightly, drawing the selected attachment member pairs and straps 90, 92 into wrapping engagement over lateral margins and the underside of the skateboard, as illustrated in FIG. 3. The shoulder strap 71–72 and 73–74 are then adjusted for fit and comfort at buckles 78, and the carrier hoisted onto the back with the arms passed through the shoulder straps, freeing the hands. If it is desired to carry also accessory skateboarding articles such as knee pads or elbow pads, a buckle strap, as illustrated in FIG. 1, is passed through a lumen passageway of the device and buckled to one of the face attachment members. School books or other relatively compact articles which are to be carried may be inserted into pocket 66 before mounting the skateboard.

As described, the present invention is useful for skateboard transport while allowing the skateboarder free use of his hands. It mounts the skateboard in a carrying position which does not interfere with locomotion or pedaling action, anchors the skateboard against vertical or reciprocating movement and from pendulous or swinging movement during locomotion or pedaling action and thereby prevents board pounding or slapping on the bearer, cushions the skateboarder from hard skateboard surfaces and offers protection form cervical contact with the skateboard, and enables the skateboarder to transport his skateboarding accessories and his schoolbooks as well as his skateboard either by attachment to attaching means supplemental to the attaching members for the skateboard or by disposition in the back panel pocket. According, it will be appreciated, the present invention promotes safety in the transport of skateboards by skateboarders both in locomotion and in bicycling or motorbiking.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A skateboard carrier, comprising:

a pair of flexible front and back panels of generally rectangular peripheral configuration with a vertical length and horizontal width of sufficient size to overlay substantially at least the upper back of a wearer, said panels having opposed upper and lower end edges and opposed side edges connecting the end edges, with fastening means fastening the opposed side edges and the opposed end edges, said fastened edges defining a cavity within said panels, a resiliently deformable foam support pad contained in said cavity and sized to occupy the width and length of said cavity to support said panels and separate the opposed said fastened side and end edges thereof in full extension one from another, a pair of shoulder straps affixed to said front panel, the place of uppermost fixation of the straps being spaced from the upper end edge of the front panel such that a portion of the carrier rises freestanding above said place of affixation, a first pair of flexible inelastic cinching strap attachment members, each member being affixed to opposite side edges of the panels at a location near the upper end edge of the panels and vertically lower than said place of uppermost fixation of said shoulder straps, a second pair of flexible inelastic cinching strap attachment members, each member being affixed to opposite side edges of the panels at a location near the lower end edge of the panels, and first and second flexible inelastic cinching straps for respective attachment to said first and second pair of attachment members, the first cinching straps being adapted to be removably positioned and cinched across the underside of a skateboard in a loop of which a forward run lies in front of, and a rear run lies behind, the axle support bracket for the skateboard wheels that are upwardly disposed when said skateboard is vertically oriented and positioned with its topside against the back panel of the carrier, the second cinching straps being adapted to be removably positioned and cinched across the underside of the skateboard in a loop of which a forward run lies in front of, and a rear run lies behind, the axle support bracket for the skateboard wheels that are downwardly disposed in the said orientation of the skateboard, whereby the weight of skateboard is supported by the said attachment members and cinching straps at the loop rear run of the cinching straps, vertical movement of the skateboard is restrained by the said attachment members and cinching straps at the loop forward run of the cinching straps, and lateral movement of the skateboard is restrained by wrap engagement of said front panel side edges at said cinching strap attachment members and by said cinching strap attachment members across portions of the lateral margins and underside of said skateboard.

2. The skateboard carrier of claim 1 further comprising:

a storage pocket having a wall that is in facing opposition with, is secured at its periphery to, and is shaped and sized to substantially conform to, a major portion of said back panel, and closure means in said back panel for providing closable access to said storage pocket.

3. The skateboard carrier of claim 2 further comprising:

at least one securing strap attachment member secured to at least one side edge of said panels intermediate said upper and lower cinching strap attachment members, and at least one securing strap for attachment to said intermediate attachment member and adapted to be removably positioned to loop through a passageway of a skateboarding accessory article selected to be securable thereby.

4. The skateboard carrier of claim 3 further comprising a mounting sheet within said cavity attached to said end and side edges and fixedly mounting and securing thereon said foam support pad at the side of the sheet facing said back panel.

5. A skateboard carrier, comprising:

a pair of flexible front and back panels of generally rectangular peripheral configuration with a vertical length and horizontal width of sufficient size to overlay substantially at least the upper back of a wearer, said panels having opposed upper and lower end edges and opposed side edges connecting said end edges, with vertical rows of stitching securing the opposed side edges and horizontal rows of stitching securing said opposed end edges, said secured edges defining a cavity within said panels, a resiliently deformable foam support pad contained in said cavity and sized to occupy the width and length of said cavity to support said panels and separate the opposed said side and end edges thereof in full extension one from another, a storage pocket having a wall that is in facing opposition with, is secured at its periphery to, and is shaped and sized to substantially conform to, a major portion of said back panel, zipper means in said back panel for providing access to said storage pocket, a pair of shoulder straps affixed to said front panel, the place of uppermost fixation of the straps being spaced from the upper end edge of the front panel such that a portion of the carrier rises above said place of affixation thereby to cushion against cervical contact with the skateboard, a plurality of flexible inelastic cinching strap attachment member pairs, each member being secured to opposite side edges of the panels, the uppermost pair being at a location near the upper end edge of the panels and vertically lower than said place of uppermost fixation of said shoulder straps, the lowermost pair being at a location near the lower end edge of the panels, and at least one other flexible inelastic cinching strap attachment member intermediate said uppermost and lowermost pairs, a plurality of flexible inelastic cinching straps for attachment to said attachment members, the cinching straps for attachment to said uppermost attachment member pair being adapted to be removably positioned across the underside of a skateboard in a loop of which a forward run lies in front of the leading edge, and a rear run lies behind the trailing edge, of the axle support bracket for the skateboard front wheels, the cinching straps for attachment to said lowermost attachment members being adapted to be removably positioned across the underside of the skateboard in a loop of which a forward run lies in front of the leading edge, and a rear run lies behind the trailing edge, of the axle support bracket for the skateboard rear wheels, when said skateboard is vertically oriented with its front wheels above the rear wheels and positioned with its topside against the back panel of the carrier so that the front and rear wheels extend outwardly from the carrier, whereby the weight of skateboard is supported by the said attachment members and cinching straps at the loop rear run of the cinching straps bearing against the said trailing edges of said brackets, vertical movement of the skateboard is restrained by the said attachment members and cinching straps at the loop forward run of cinching tie straps bearing against said leading edges of said brackets, and lateral movement of the skateboard is restrained by wrap engagement of said front panel side edges at said cinching strap attachment members and by said cinching strap attachment members across portions of lateral margins and underside of said skateboard, and at least one securing strap for said intermediate attachment member adapted to be removably positioned to secure to said carrier a skateboarding accessory article selected to be securable thereby.

* * * * *